United States Patent [19]

Bartlett et al.

[11] Patent Number: 4,865,117

[45] Date of Patent: Sep. 12, 1989

[54] DIRECT STRIP CASTING ON GROOVED WHEELS

[75] Inventors: Edwin S. Bartlett; Robert E. Maringer, both of Worthington; Judith J. Rayment, Columbus, all of Ohio

[73] Assignee: Battelle Development Corporation, Columbus, Ohio

[21] Appl. No.: 220,902

[22] Filed: Jul. 19, 1988

Related U.S. Application Data

[63] Continuation of Ser. No. 47,566, Apr. 27, 1987, abandoned, which is a continuation of Ser. No. 786,789, Oct. 11, 1985, abandoned.

[51] Int. Cl.[4] ..... B22D 11/00; B22D 11/06

[52] U.S. Cl. ..... 164/479; 164/488; 164/429

[58] Field of Search ..... 164/463, 479, 427, 423, 164/429, 433, 482, 488

[56] References Cited

U.S. PATENT DOCUMENTS

| | | | |
|---|---|---|---|
| 105,112 | 7/1870 | Millingar | 164/429 |
| 993,904 | 5/1911 | Strange | 164/429 |
| 1,831,060 | 11/1931 | Drake | 164/479 |
| 3,345,738 | 11/1964 | Mizikar | 164/463 |
| 3,789,909 | 2/1974 | Smith | 164/479 |
| 3,871,439 | 3/1975 | Maringer et al. | 164/429 |
| 4,484,614 | 11/1984 | Maringer | 164/463 |

FOREIGN PATENT DOCUMENTS

| | | | |
|---|---|---|---|
| 0147912 | 7/1985 | European Pat. Off. | 164/463 |
| 1364717 | 5/1964 | France | 164/429 |
| 27608 | 2/1980 | Japan | 164/429 |

*Primary Examiner*—Richard K. Seidel
*Assistant Examiner*—Samuel M. Heinrick
*Attorney, Agent, or Firm*—Barry S. Bissell

[57] ABSTRACT

Metal strip may be directly cast by deposit of a melt layer onto a chill surface. Quality of both the upper and lower surfaces of strip case in this manner may be substantially improved according to the invention by casting on a chill roll having fine, circumferential, surface grooving of a particular geometry.

7 Claims, 2 Drawing Sheets

DIRECT STRIP CASTING ON GROOVED WHEELS

This is a continuation of co-pending application Ser. No. 047,566 filed on 4/27/87, which is a continuation of application Ser. No. 786,789 filed on 10/11/85, both now abandoned.

BACKGROUND OF THE INVENTION

The invention relates to a novel method for making metal strip or sheet directly from a molten mass of the metal. From prior patents issued to King (U.S. Pat. Nos. 3,522,836 3,605,863) and others, it is known how to make strip in this manner. King discloses a method whereby a layer of the liquid metal is deposited onto the smooth, outer, cylindrical surface of a chilled roller by a so-called melt drag process. In the melt drag process the moving substrate passes through a meniscus of liquid metal delivered by an orifice and drags the metal from the orifice. The layer quickly solidifies on the chill surface and is removed as a strip.

By the above melt drag method or, so far as we know, by other methods not utilizing an orifice for delivery, the surface of metal strip formed by rapidly chilling a molten metal layer on a smooth substrate may contain various casting defects. These defects are generally a vestige of poor (thermal) contact regions of the liquid metal with the substrate. The poor contact results in slower solidification of metal than in adjacent regions of good contact.

A patent to Buxmann, et al. (U.S. Pat. No. 4,250,950) discloses a metal mold with projections for controlling the rate of metal solidification, but apparently not for improving surface finish as proposed herein.

Other methods exist for producing strip which replicates the surface of the drum (see U.S. Pat Nos. 2,561,636 and 4,212,343, for example). Such methods are not relevant to the present invention because the method produces smooth metal strip which preferably does not replicate the drum. A rather smooth finish is desired so that the strip may be formed and used as cast (such as for roof gutters, for example) or may be further formed into useful shapes with only a minimum of cold rolling.

SUMMARY OF THE INVENTION

It is an object of the present invention to improve the surface quality (reduce surface defects) in metal strip formed on a chill surface directly from the melt.

The improved method comprises casting a molten metal layer on the outer cylindrical surface of a chill roll or drum having generally circumferential grooves therein separated by land areas and wherein the groove frequency is at least about 8 grooves/centimeter. Typically, the melt does not completely fill the grooves and neither the lower nor the upper surface replicates the groove shape. A periodic undulation is generally present in the lower surface of most strip and may also be present on the upper surface of thin strip cast on widely spaced grooves.

Preferably the grooves are cut with an included angle of between about 30 and 60 degrees and a depth of about 0.025–2 mm. The land region between grooves may vary from about 0.025–0.635 mm in width and the ratio of land width to the groove width is preferably greater than 0.15 and more preferably between about 0.5 and 1.5.

DESCRIPTION OF THE PREFERRED EMBODIMENTS

Figure 1:
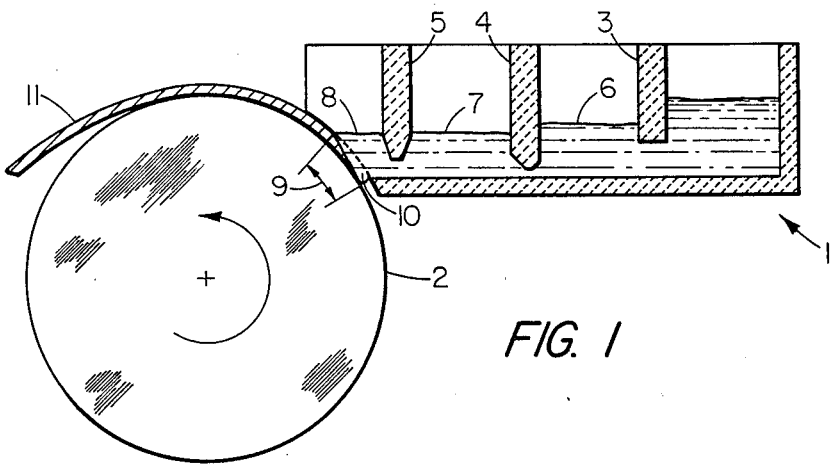
FIGS. 1 and 2 show a schematic elevation and plan view, respectively, of one tundish and drum assembly for casting metal strip.
Figure 2:
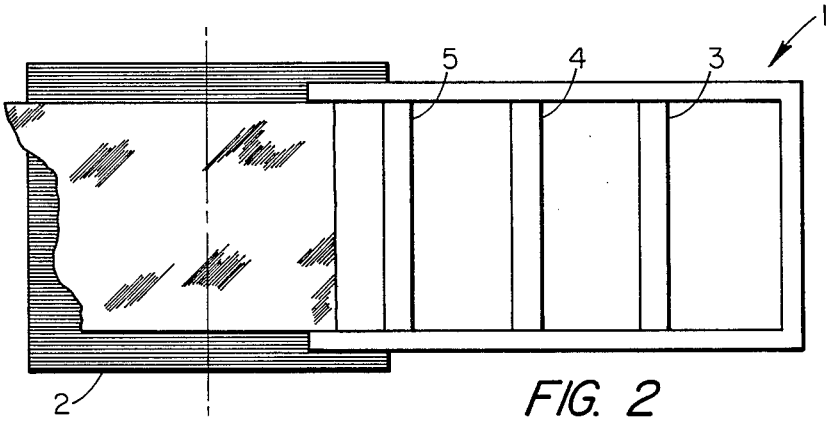

FIGS. 1 and 2 show schematic views of one tundish and chilled roll or drum assembly for practicing the invention. The cylindrical drum 2 is mounted for rotation relative to the tundish 1 and is conventionally water cooled (not shown). The tundish 1 has a contour matching the roller surface at one end and is spaced from the drum 2 such that the liquid metal 10 will not spill during rotation of the drum. Weir 4 smooths out the flow of liquid metal which is made-up by pouring into the tundish at the opposite end from the wheel. Dam 3 forms a pouring chamber with the tundish back wall. Dam 3 and weir 4 also control the melt level 6 and 7 respectively. Weir 5 may be used to control the melt level 8 (the metalostatic head height) and also to control the contact length 9 of the melt with the drum. This contact length is important for controlling the thickness of the strip 11. The weir 5 may alternatively be closely spaced from the drum surface to meter the liquid metal to the surface, i.e. serving as an orifice. Liquid metal 10 contacts the cooled drum and solidifies to the solid strip 11 before removal from the drum.

Figure 3:
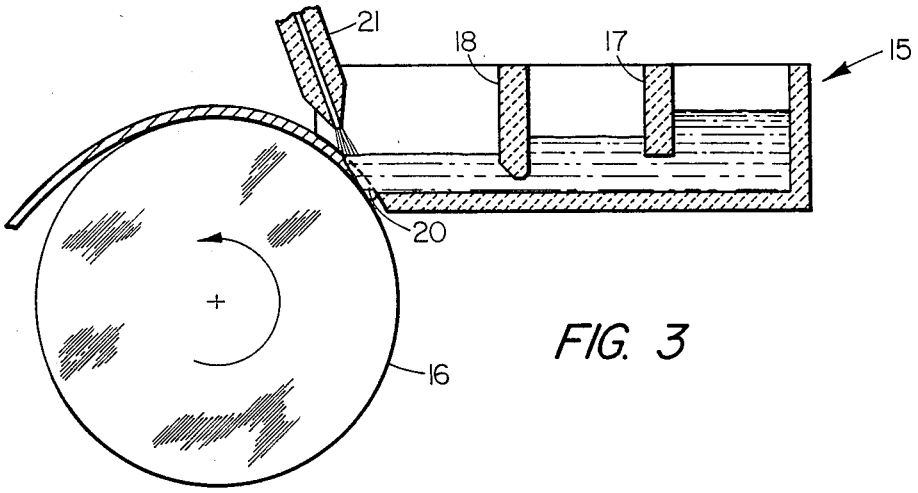
FIG. 3 shows a schematic elevation view of a second tundish design and drum assembly including a gas knife for casting metal strip.

A second assembly for practicing the invention is shown in FIG. 3. The drum 16 and tundish 15 are substantially the same as in FIG. 1, except that only one weir 18 is present. Liquid metal 20 is contacted with the cooled drum and the contact length and thickness thereof is controlled by the impact of a pressurized gas stream issuing from a gas knife 21. The gas knife is similar to that used in the hot dip galvanizing art, but operational parameters are quite different. Control of the melt thickness (and therefore the metal strip thickness) has been shown to be somewhat better with the gas knife than with the extra weir 5 shown in FIG. 1. Typically, the bottom of the tundish approaches the drum at a point about 30° from horizontal, but this point of approach may vary substantially depending on the drum diameter, casting speed and desired strip thickness. The gap between the drum and the tundish may be on the order of 0.15–1.00 mm and the melt contact length with the drum on the order of 4–120 mm.

Apparatus including that shown in FIG. 1 have been used in the past for casting metal on a smooth, cylindrical drum surface (for example, a machined surface ground through 600-grit sanding paper) Unfortunately, when metal such as aluminum, copper or steel alloys are cast on smooth wheels, surface defects may arise in wide strip (greater than about three inches). These defects are visually perceived in the strip surface as either points, lines or networks of discoloration, texture, relief and/or cracking depending on the severity. The defects appear to be related to areas of poor contact of the liquid metal with the drum surface causing slower solidification of such areas relative to adjacent areas. This differential solidification appears to permanently define a defect region in the solidified strip which is a vestige of the poor contact.

The term "dimple" is used to mean a shallow defect area of 1–2 mm in diameter having a matte surface compared to the otherwise reflective appearance of the strip surface. The dimple is a common defect which the present invention may reduce. The linear defects typically form an irregular mosaic pattern of depressions which may be the site of cracking. As a result of the slow solidification, bottom surface dimples may result in top surface craters and bottom surface linear depressions result in top surface valleys. Both result in variations in nucleation and grain growth in the regions.

It has been found that these defects can be reduced substantially and both the upper and lower surfaces of the strip can be made smoother by casting on a drum with circumferential grooves in the casting surface. Helical (threaded) or straight-machined grooves are equally acceptable so long as the grooves are substantially circumferential and closely spaced. Grooving results in what is known as a land-and-groove surface having alternating grooves separated by raised land regions.

Figure 4:
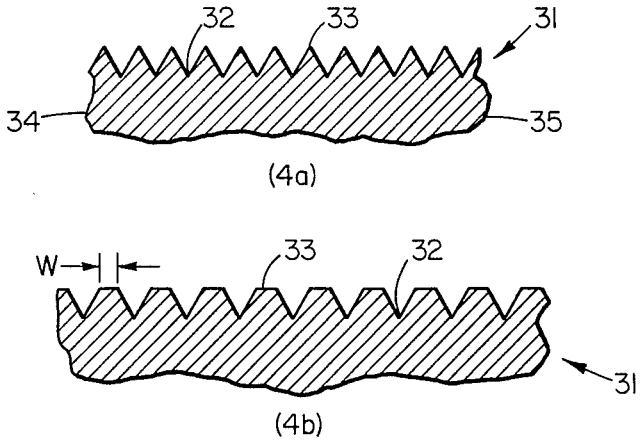
FIG. 4 shows two cross-sectional views of land and groove geometries which may be used to cast improved strip according to the invention.

FIG. 4 shows common grooving which is useful in the invention. In FIG. 4(*a*) a simple "V" shaped groove 32 has been uniformly machined in the surface of a drum 31 (shown in cutaway). The land regions 33 approach zero width in this grooving and are described as tips or sharp projections. In FIG. 4(*b*) the tips have been removed such that land regions 33 have a width $\omega$ separating grooves 32. Frequently, the machining process results in a variable pattern of tips and lands which may also be useful but is not preferred. Extended use and cleaning of the drum may round the tips and flatten the lands.

It has been found that the drum surface should have a groove frequency of about 8–35 grooves/centimeter measured axially along the surface of the drum from edge 34 to edge 35 in FIG. 4(*a*). The grooves need not be "V" shaped but preferably have an average depth of about 0.025–0.2 millimeters. If they are "V"-shaped, the included angle formed by the walls is preferably about 30°–60°. The land regions preferably have an average width of about 0.025–0.635 millimeters. However, the term land is also used herein to include a land width of essentially zero where the land is a sharp projection. Preferably the ratio of average land width to average groove width is about 0.5–1.5, but patterns outside of this range are useful. Generally, only the high land to groove ratio is not particularly useful in producing significant improvement in strip quality as the drum surface approaches the prior art continuous (ungrooved) condition. The grooving need not be uniform but is preferably so.

Figure 5:
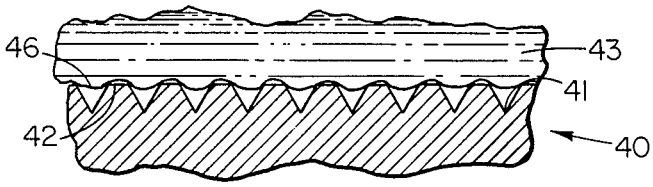
FIG. 5 is a representation of the liquid metal behavior at the surface in contact with the grooved drum.

Delivery of the molten metal at reasonable pressure to the high frequency grooving results in a pattern in which the liquid metal does not completely fill the grooves. FIG. 5 shows a condition of the liquid metal 43 immediately after deposit. The lower surface of the metal is depressed (at 46) into grooves 41 in the drum 40. The surface tension of the liquid may cause the liquid metal to be raised over the land regions 42 between depressions but other pressures may depress the liquid in the groove. Upon solidification the depressions 46 may, depending on strip thickness, rise above the drum surface due to shrinkage resulting in an undulating lower surface. Except in very thin metal strip and large spacing of grooves, the undulation in the lower surface caused by the grooves is not replicated in the upper surface of the strip. The actual shape of the grooving is not replicated in either the lower or upper surface.

The casting drum is preferably water cooled. It may be made of any convenient metal which will withstand the conditions, in particular, the temperature of the molten metal. For example, copper, copper-chromium, steel or aluminum alloy drums may be used selectively for casting aluminum, copper and steel. The grooves may be introduced, for example, by machining or, when the metal is soft enough, by roll threading or embossing. Preferably, a cloth or wire wiper is used with the drum for keeping the grooves clean during use.

Sticking may be more frequent than with a smooth wheel if the grooves are rough. This can be caused by over-aggressive redressing or wiping of the drum surface causing burrs to form on the land edges. Too high a pressure on the liquid metal during casting on such rough surfaces forces the metal too deeply into the grooves where the metal can solidify on the burrs.

Drum speeds during the casting operation are on the order of 100–1000 cm/sec. Lower speeds can be used to produce thicker strip but, as with any casting process, this would generally result in lower productivity. At the upper end of the stated range and above, the cast strip tends to become thinner as the metal contact time is decreased. Depending on the groove size, this can result in replication of the groove-induced undulation in the upper surface of the strip. For some uses this is not detrimental. Drum size (width and diameter) does not appear to be critical so long as effective cooling can be accomplished and metal can be delivered at the proper rate from the tundish.

EXAMPLES OF THE PREFERRED EMBODIMENTS

So far as we know, strip directly cast on a cooled drum by other apparatus and methods may benefit from the grooving of the drum according to the invention. However, our experimental trials have been made on smooth and grooved drums using, primarily, the apparatus as shown in FIGS. 1–3. The drums were made with either copper, copper-1% chromium alloy, steel or aluminum alloy. Metals cast were aluminum alloy 3105 (nominally Al-0.5% Mg-0.5% Mn), OFHC Copper and low-carbon steel (nominally Fe-0.35% Mn 0.05% C). The cast strip is preferably crystalline with a thickness of greater than 0.25 mm.

"V"-shaped grooves were introduced by single-point machining or rolling. Acetate replicas of the wheel surfaces taken after runs and samples of the as-cast strip were examined with a profilometer and compared.

EXAMPLE 1 THICKNESS VARIATION

Qualitatively, it is easy to see the difference in strip quality using smooth and grooved wheels. Quantitatively, a definitive measure of strip quality is the thickness variation over a small area, for example one square inch, of the cast product due to defects. Measurements with flat and point micrometers were taken on samples cast on smooth wheels and those cast on grooved wheels according to the invention. The statistical difference between thickness measurements taken with flat micrometers and those with point micrometers weighted by the nominal thickness of the material (e.g.

the percent difference) gives an indication of thickness variation over closely spaced regions. The similarly weighted difference between flat micrometer measurements and thickness calculated from the weight, length, width and density of the material gives a similar indication but without the subjective skill required to read a point micrometer. The results in Table 1 for 25.4 cm wide strip continuously cast on a 71 cm diameter drum show that the thickness varies by twice as much over a small region of smooth-wheel-cast aluminum strip versus grooved-wheel-cast aluminum strip. Also, the scatter in the data (e.g., the "s" values) is much less for product cast on the grooved drums.

TABLE 1

| Strip Cast on: | N | $\Delta \bar{t}_m$ | $S_m$ | $\Delta \bar{t}_c$ | $S_c$ |
|---|---|---|---|---|---|
| Smooth Wheel | 21 | 29.5 | 7.8 | — | — |
| Grooved Wheel | 2 | 14.0 | 1.4 | 11.5 | 0.2 |
| | 6 | — | — | 11.1 | 1.4 |

Where:
N = number of casting experiments for which average thickness difference statistics were evaluated. For each experiment, several individual samples were measured.
$t_m$ = average measured thickness variation, percent (point micrometer vs. flat micrometer) among N experiments
$S_m$ = standard deviation, percent (among N experiments)
$t_c$ = average calculated thickness variation, percent (flat micrometer vs. calculated from density)
$S_c$ = standard deviation, percent (among N experiments)

Numerous (typically 10 to 20) sample measurements of thickness with flat and point micrometers were compiled to determine the average percent difference for strip from each of 21 separate strip casting trials on a smooth wheel representing different casting speeds, pool, thickness, etc. These averages were then combined, resulting in an overall average, "$\Delta \bar{t}_m$", with a variability defined as "$S_m$" for smooth-wheel casts.

Two separate grooved wheel strip casting experiments were evaluated in the above manner, and also by the similar (but easier) comparative method utilizing flat micrometer readings and "calculated thickness" values.

Table 1 shows:

a. A direct comparison between $\Delta \bar{t}_m$ and $S_m$ for smooth and grooved wheels, and b. The relationship between $\Delta \bar{t}_m$ and $\Delta \bar{t}_c$, and between $S_m$ and $S_c$ for the same materials cast on a grooved wheel.

An additional 6 experiments on a grooved wheel were evaluated by the easier $\Delta \bar{t}_c$ method only. The results between the "group of 2" and the "group of 6" were statistically identical. By inference, we conclude that the "group of 2" and "group of 6" would have shown statistically identical $\Delta \bar{t}_m$ values if these had been determined for the "group of 6". This leads to the conclusion that the relative variability in thickness of product cast on "grooved" wheels is only about half of that for material cast on smooth wheels. The same conclusion results from $\Delta \bar{t}_m$ for only rows 1 and 2 of Table 1, but the added $\Delta \bar{t}_c$ values of row 3 make this conclusion much more certain.

EXAMPLE 2

Several trials were made using apparatus such as shown in FIG. 1 with a "smooth" wheel (i.e. a machined surface ground through 600-grit $Al_2O_3$ sanding paper then finished to a matte surface by peening with a rotating stainless steel brush). Aluminum 3105 alloy was melted and introduced to the chilled copper drum in a thin layer by the tundish. The drum surface was moving at between about 4 and 6 meters/second. A rotating wiper was used to keep the drum surface clean. A metallostatic head of about 4 inches was required to produce strip in a rather continuous mode. Strip quality varied, but dimples and other surface defects were plainly visible in virtually all the strip.

Trials with copper and steel on smooth drums produced similar defects in cast strip.

EXAMPLE 3 GROOVED DRUM CASTING

Additional trials were run using grooved drums. Table 2 gives the conditions of each run. Runs 99, 102 and 119 were run with a gas knife present. The gas knife was positioned so that a flow of gas (usually nitrogen, but can be air, argon, or some other suitable gas) impinges on the liquid metal of the casting pool at approximately the line of intersection of the forward edge of the liquid metal and the casting wheel (i.e., the solidified strip is between the wheel and gas flow after casting is started).

The grooves appear to afford a preferred site (on the lands) for initiation of solidification and afford channels for escaping of entrained gases. Cast strip using the grooved drums showed substantially less defects on upper and lower surfaces than strip cast on smooth drums and substantially less thickness variability.

TABLE 2

GROOVED WHEEL RUNS

| Run No. | Cast Metal | Wheel Metal | Groove Frequency (per cm) | Groove Width (mm) | Groove Depth (mm) | Land Width (mm) | Ratio Land to Groove Width | Groove Angle | Wheel Speed (m/sec) | Strip Thickness (mm) |
|---|---|---|---|---|---|---|---|---|---|---|
| 40 | Cu | Cu—Cr | 21.2 | 0.75 | 0.122 | 0.118 | 0.15 | 37° | 3.04 | 0.26-0.36 |
| 85 | 3105 Al | Cu | 19.3 | 0.78 | 0.144 | 0.113 | 0.15 | 37° | 2.98 | 0.69 |
| 102 | 3105 Al | Cu | 30.4 | 1.00 | 0.134 | 0 | 0 | 60° | 3.35 | 0.46 |
| 99 | 3105 Al | Cu | 13.8 | 0.83 | 0.206 | 0.122 | 0.15 | 60° | 3.00 | 0.66 |
| SPEC | 3105 Al | Steel | 7.9 (helical) | 1.00 | 1.1 | 0 | 0 | 60° | ~0.16 | ~1.1 |
| 66 | 3105 Al | Cu—Cr | 15.8 | 0.36 | 0.178 | 0.406 | 1.12 | 37° | 3.56 | 0.47 |
| 63 | 3105 Al | Cu—Cr | 31.5 | 0.68 | 0.178 | 0.102 | 0.15 | 37° | 3.00 | 0.71 |
| 113 | Steel | Cu—Cr | 11.8 | 0.25 | 0.152 | 0.635 | 2.56 | 37° | 2.00 | 0.58 |
| 119 | Steel | Cu—Cr | 19.7 | 0.60 | 0.152 | 0.203 | 0.33 | 37° | 2.00 | 0.54 |

I claim:

1. The method for casting commercial quality metal sheet of thickness less than about 10 millimeters directly from the melt comprising grooving the outer cylindrical surface of a chill wheel with axially-spaced, substantially circumferentially extending grooves to produce a casting surface with a groove density of at least about 8 grooves per centimeter, substantially cylindrical flat land regions between adjacent grooves and generally circumferential edges at the intersections of each land region with the adjacent grooves, rotating the chill wheel and passing the grooved outer cylindrical surface through a melt pool to extract a melt layer onto the grooved outer surface wherein the upper surface of the melt layer directly contacts the land regions and substantially spans the groove between land regions and wherein the upper surface of the melt layer is unconfirmed and directly exposed to the atmosphere, and withdrawing heat from the melt layer through the grooved surface to progressively solidify the melt layer from the grooved surface to the melt layer upper surface.

2. The method of claim 1 for casting commercial quality metal sheet of thickness less than about 10 millimeters directly from the melt further comprising holding the melt pool in an open tundish having one wall defined by the outer cylindrical surface of the chill wheel and wherein the chill wheel is rotated in a direction to move the outer surface upwardly through and out of the melt.

3. The casting method of claim 1 which further includes casting at such a speed and delivering the molten metal at such a rate so as to form a crystalline metal strip of thickness greater than about 0.25 millimeters.

4. The casting method of claim 3 which further includes introducing the metal melt onto the substrate surface having a ratio of average land width to average groove width of between 0.5 and 1.5.

5. The casting method of claim 4 wherein the groove depth is between about 0.025 and 0.2 millimeters.

6. The casting method of claim 3 which further comprises introducing the metal melt onto a peripheral surface of a drum rotating at about 100–1000 cm/sec, wherein the grooves are generally circumferential in the peripheral surface with a depth of about 0.025–0.2 millimeters and wherein the grooves are separated by land regions having a width of less than about 0.635 millimeters.

7. The casting method of claim 6 wherein the land regions have a width of between about 0.025 and 0.635 millimeters.

* * * * *

UNITED STATES PATENT AND TRADEMARK OFFICE

CERTIFICATE OF CORRECTION

PATENT NO. : 4,865,117

DATED : September 12, 1989

INVENTOR(S) : Edwin S. Bartlett, Robert E. Maringer & Judith J. Rayment

It is certified that error appears in the above—identified patent and that said Letters Patent is hereby corrected as shown below:

Column 1, Line 39, "method produces" should read -- present method produces --

Column 7, Line 4, the word "upper" should read -- lower -- .

Column 7, Line 6, the word "groove" should read -- grooves -- .

Signed and Sealed this

Twenty-sixth Day of February, 1991

*Attest:*

HARRY F. MANBECK, JR.

*Attesting Officer*

*Commissioner of Patents and Trademarks*